US006640761B2

(12) United States Patent
Dolderer et al.

(10) Patent No.: US 6,640,761 B2
(45) Date of Patent: Nov. 4, 2003

(54) CONTROL DEVICE FOR AN INTAKE VALVE OR EXHAUST VALVE OF AN INTERNAL COMBUSTION ENGINE

(75) Inventors: Frank Dolderer, Mutlangen (DE); Volker Korte, Bissingen (DE); Christoph Steinmetz, Ludwigsburg (DE); Martin Lechner, Stuttgart (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 10/258,780

(22) PCT Filed: Apr. 20, 2001

(86) PCT No.: PCT/DE01/01532

§ 371 (c)(1),
(2), (4) Date: Oct. 28, 2002

(87) PCT Pub. No.: WO01/83952

PCT Pub. Date: Nov. 8, 2001

(65) Prior Publication Data

US 2003/0101955 A1 Jun. 5, 2003

(30) Foreign Application Priority Data

Apr. 28, 2000 (DE) ..... 100 20 884

(51) Int. Cl.[7] ..... F01L 1/18

(52) U.S. Cl. ..... 123/90.44; 123/90.43; 123/90.39; 123/90.16

(58) Field of Search ..... 123/90.15–90.18, 123/90.31, 90.39–90.55, 90.6

(56) References Cited

U.S. PATENT DOCUMENTS

| | | | | |
|---|---|---|---|---|
| 4,726,332 A | | 2/1988 | Hirofumi et al. | 123/90.16 |
| 5,042,437 A | | 8/1991 | Shigeru et al. | 123/90.16 |
| 5,085,182 A | * | 2/1992 | Nakamura et al. | 123/90.16 |
| 5,183,015 A | * | 2/1993 | Morita et al. | 123/90.16 |

(List continued on next page.)

FOREIGN PATENT DOCUMENTS

| | | | |
|---|---|---|---|
| DE | 2753197 | 6/1978 | F01L/1/18 |
| DE | 3219611 | 12/1982 | F01L/1/12 |
| DE | 3613945 | 10/1986 | F01L/1/04 |

(List continued on next page.)

OTHER PUBLICATIONS

"Multi–Mode Variable Valve Timing Engine", Automotive Engineering, Society of Automotive Engineers. Warrendale, US, vol. 102, Nr. 2, Page(s) 111–114 XPOOO426931 ISSN: 0098–2571.

*Primary Examiner*—Thomas Denion
*Assistant Examiner*—Kyle Riddle
(74) *Attorney, Agent, or Firm*—Collard & Roe, P.C.

(57) ABSTRACT

A control device for an intake valve of an internal combustion engine comprising an adjusting element and a control element. According to the invention, the adjusting element comprises a base body (2) and is displaceably arranged between the control element and the valve. The control element rotates during the operation of the control device. Rotating control element circumferential areas with contours that vary in the circumferential direction are provided as control cams throughout the rotating control element. Force introduction areas KEB (6, 7), which are positioned in a non-uniform manner, and a force transfer area KUB (3) are provided on the base body (2) of the adjusting element. Switching means for the alternately M contacting assignment of the KEB areas (6, 7) are provided on the different control cam areas of the control element The aim of the invention is to enable the largest possible number of different controls for an engine valve. To this end, the invention provides that, ("f") in a control device of this type, the mutual assignment between the one KUB area (3) and the at least two KEB areas (6,7) can be modified among one inside the adjusting element base body (2) by means of the switching means.

4 Claims, 4 Drawing Sheets

U.S. PATENT DOCUMENTS

Figure 1:
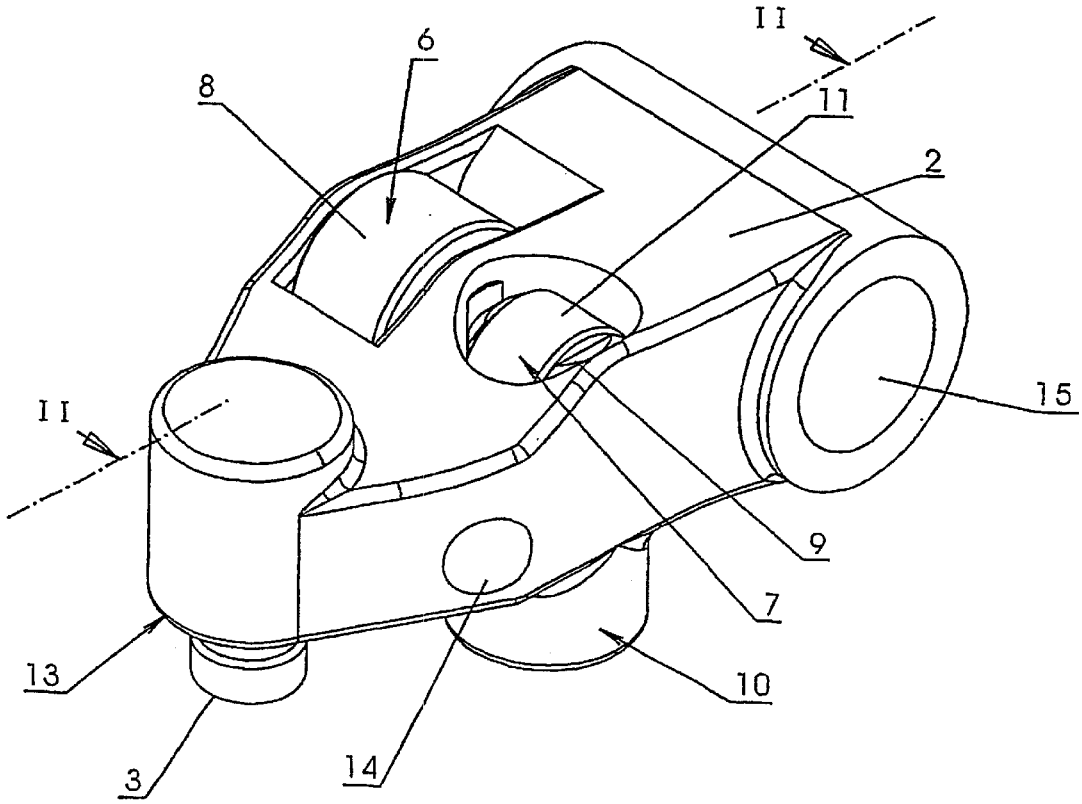

| | | | | | |
|---|---|---|---|---|---|
| 5,529,033 | A | * | 6/1996 | Hampton | 123/90.16 |
| 5,544,626 | A | | 8/1996 | Diggs et al. | 123/90.16 |
| 5,564,373 | A | | 10/1996 | Hara | 123/90.16 |
| 5,685,264 | A | * | 11/1997 | Allen et al. | 123/90.16 |
| 6,112,711 | A | * | 9/2000 | Shimizu et al. | 123/90.16 |

FOREIGN PATENT DOCUMENTS

| | | | |
|---|---|---|---|
| DE | 4136143 | 5/1993 | F01L/1/12 |
| DE | 19621463 | 12/1997 | F01L/1/26 |
| DE | 3800347 | 9/1998 | F01L/1/26 |
| DE | 19802738 | 7/1999 | F01L/1/12 |
| EP | 0420159 | 4/1991 | F01L/1/26 |
| EP | 0458857 | 9/1993 | 123/321 |
| EP | 0775251 | 1/2000 | 123/321 |
| FR | 2709149 | 2/1995 | F01L/1/04 |
| FR | 2709150 | 2/1995 | F01L/1/04 |
| JP | 55152308 | 11/1980 | F01L/1/04 |
| JP | 02095708 | 4/1990 | F01L/13/00 |
| JP | 02252910 | 10/1990 | F01L/13/00 |
| JP | 03179115 | 8/1991 | 123/90.48 |
| JP | 06088512 | 3/1994 | F01L/13/00 |
| JP | 07077019 | 3/1995 | F01L/13/00 |
| JP | 07317081 | 12/1995 | E02D/27/01 |
| JP | 10077815 | 3/1998 | F01L/13/00 |

* cited by examiner

CONTROL DEVICE FOR AN INTAKE VALVE OR EXHAUST VALVE OF AN INTERNAL COMBUSTION ENGINE

CROSS REFERENCE TO RELATED APPLICATIONS

Applicants claim priority under 35 U.S.C. §119 of GERMAN Application No. 100 20 884.3 filed on Apr. 28, 2000. Applicants also claim priority under 35 U.S.C. §365 of PCT/DE01/01532 filed on Apr. 20, 2001. The international application under PCT article 21(2)was not published in English.

The invention relates to a control device for an intake or exhaust valve of an internal combustion engine according to the preamble of patent claim 1.

For control devices with the characteristics a to f of the preamble of claim 1, various valve controls can be switched in relation to varying loads or motor brake operation for example. Such devices of the most diverse embodiments are known, for example, from DE 27 53 197 A1, DE 36 13 945 A1, DE 38 00 347 A1, DE 41 36 143 A1, EP 0 775 251 B1, U.S. Pat. No. 5,544,626 and JP 6-88 512 A.

With all these devices where the control element is a cam shaft, the different contours of the control cams on the cam shaft have to fall inside each other, i.e. within an envelope curve which is determined by the control curve of the control cam with the greatest sweep. Otherwise, these known devices cannot operate. In systems such as EP 0 458 857 B1 for example, a switch between different control contours occurs such that in a control state with play, a standard control contour is achieved. In a further control state, the entire cam profile for the valve motion available on the cam shaft is activated by removing the play. The additional control contour is engaged while the standard contour in such a system cannot be disengaged. The control contour is proportional to the entire envelope curve of the cam shaft. To the extent that, for the control device according to EP 0 775 251 B1, a valve control predetermined by the control curve of the control cam can be varied in conjunction with a hydraulic unit, not just any desired valve controls can be achieved. Neither can the stroke of the standard motion be disengaged.

Similar control devices with similar disadvantages and sometimes with particularly complex design features are also known from DE 32 19 611 A1, FR 27 09 150 A1, FR 27 09 149 A1, U.S. Pat. No. 5,564,373, JP 55-152308 U and from JP Patent Abstracts of Japan: 10077815 A, 07317081 A, 07077109 A, 03179115 A, 02252910 A as well as 02095708 A.

The genre-forming state of the art, from which the preamble of patent claim 1 has been derived, is "MULTI-MODE VARIABLE VALVE TIMING ENGINE", AUTOMOTIVE ENGINEERING, SOCIETY Of AUTOMOTIVE ENGINEERS. WARRENDALE, US, VOL. 102, No. 2, PAGE(S) 111–114 XP000426931 ISSN: 0098-2571.

In a generically appropriate device, the invention deals with the problem of enabling a simple and reliable switching of KEB areas, being in a state of force transmission, between control element and valve.

This problem is solved by the design of a generically appropriate control device according to the characteristic features of claim 1.

In the above-mentioned, genre-forming, known device, the KEB areas are in constant contact with the correlated control curve areas of the control element whereby only the KEB area not transmitting any force is held, without being locked, in the base body of the adjustment element such that it can follow the control curve without acting in a force-transmitting way. The required locking of that KEB area being switched to force transmission at the time, takes place not hydraulically but mechanically with the engagement of a pin in the movably mounted part of the KEB area. Only the pin is moved hydraulically, but its locking force is based on mechanical engagement rather than hydraulic forces. Due to the mechanical locking technique for the KEB areas, employed for this known device, switching is only possible for states of motion where the pin and the locking hole correlated to it are in line with each other which in practice is only possible when the relevant KEB area to be switched is correlated with the base circle areas of the control curve of the cam shaft. Otherwise, a locking between the component containing the KEB area and the base body of the adjustment element is virtually impossible.

The invention according to claim 1 differentiates itself by the features g, h, i, j and k from the device according to U.S. Pat. No. 4,726,332. The essential difference can especially be found in the fact that for those devices, a control curve area of the cam shaft can only be disengaged if control curves are used which are not contained within the envelope curve of the above-mentioned control curve. This is a serious disadvantage compared to the teaching according to the invention so that said known device does not solve the problem in terms of the invention.

The same applies in relation to the device according to U.S. Pat. No. 5,042,437, where there is always a KEB area, too, which cannot be disengaged from a correlated control curve of the control shaft.

Advantageous and useful embodiments of the invention are the subject of the dependent claims.

If, between control elements with differing control curves and the valve to be controlled, an adjusting element is introduced whose points of engagement with the control curves and the valve can be infinitely adjusted relative to each other as desired, any desired, differing correlation to each other can be set. That way, any control settings can be achieved in a simple manner. As a control element, a cam shaft with differing control curves can be used or several cam shafts with differing control curves each can also be used. When using several cam shafts as a control element, the variability of the possible control settings is increased. Thus, especially cam shafts rotating at different speeds can be used.

Hydraulic units are used as switching means. The use of hydraulic units has the advantage that the moment transfer ranges of the adjusting element relative to the control element, on the one hand, and/or the valve, on the other hand, can be integrated. Thus, the valve play compensation measures, basically known for engine valve controls, can be integrated easily into these hydraulic units.

Advantageously, drag levers or rocker arms can be used as adjusting elements. It is also possible to use an adjusting element capable of linear motion only. Preferably, the force transfer takes place at the end of a valve stem or, if several valves are being operated, onto an intermediate element such as a valve bridge.

Useful and advantageous embodiments of the invention are presented in the drawing.

Figure 2:
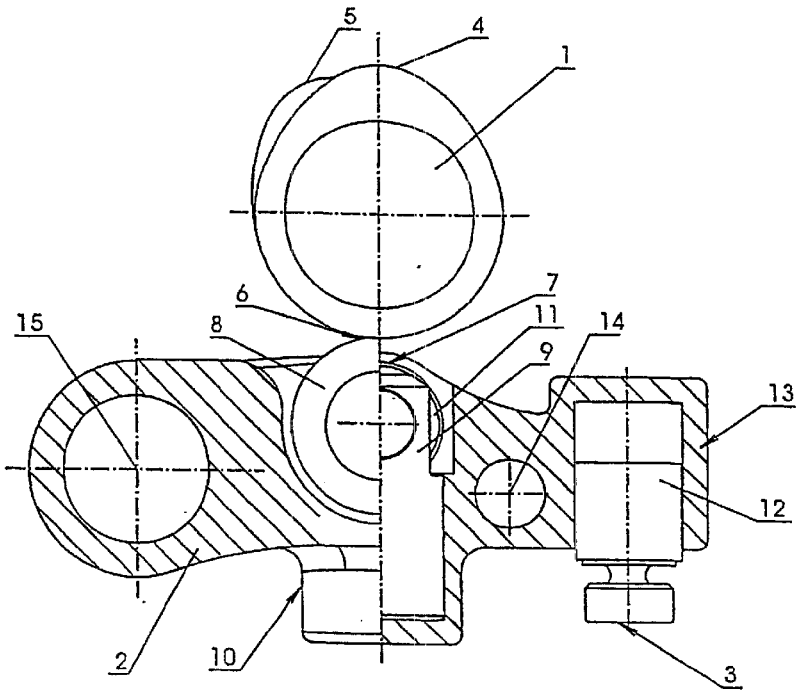
Figure 3:
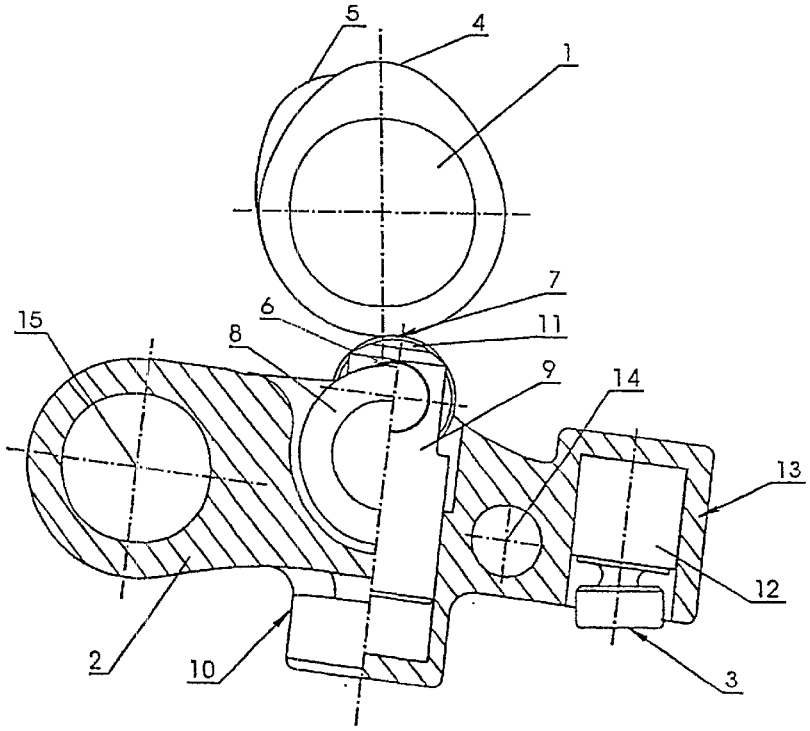
Figure 4:
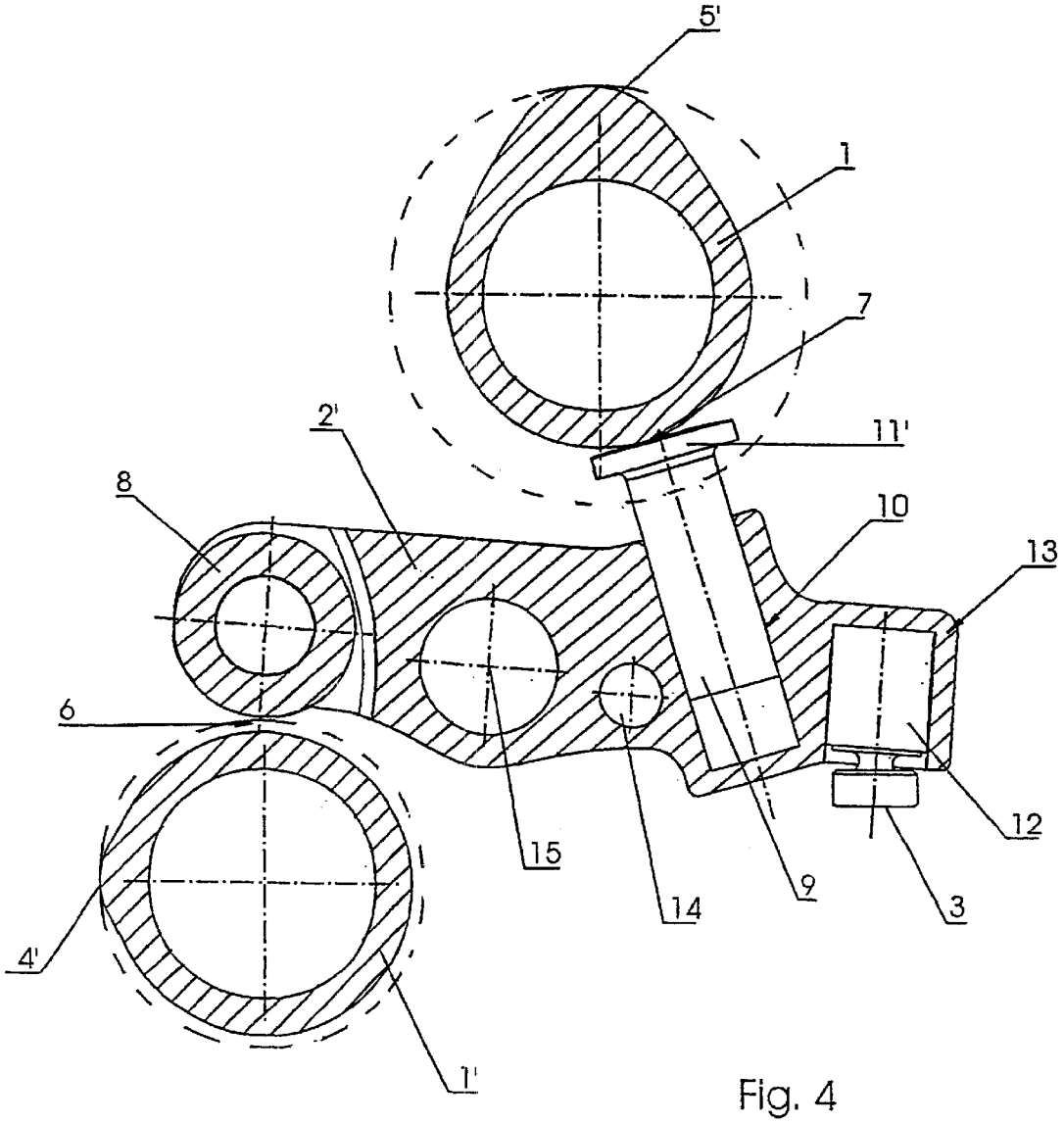
Figure 5:
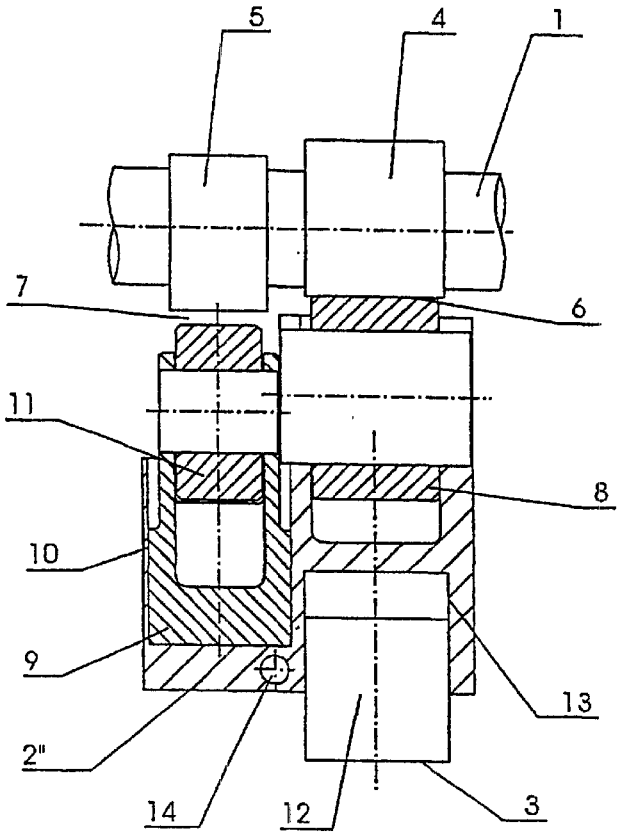
Figure 6:
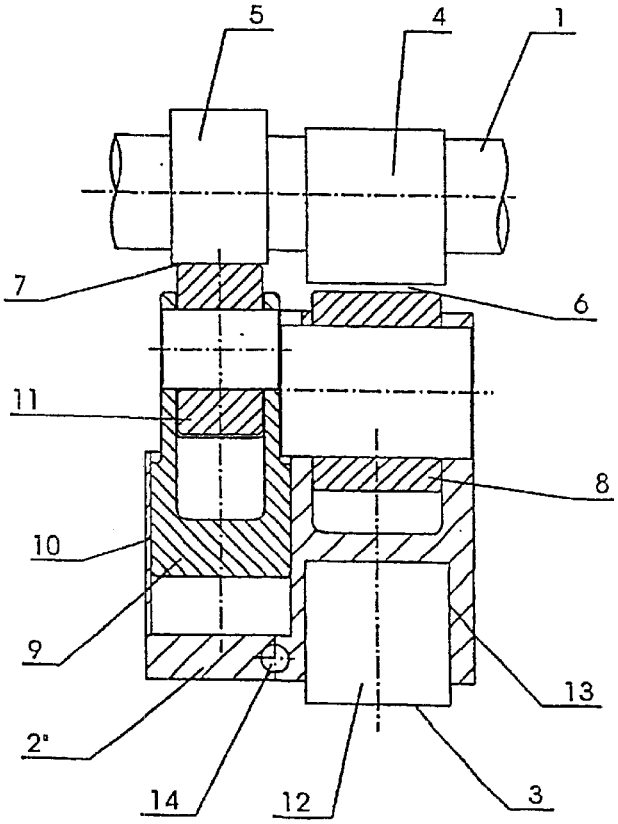

Shown are:

FIG. 1 a perspective view of a drag lever as a control element,

FIG. 2 a section through the drag lever along the line II—II in FIG. 1 with an additional view of a cam shaft controlling this drag lever, in a first control state of the force introduction and transfer areas of this drag lever, FIG. 3 the drag lever in the view according to FIG. 2 in a different control position of the force introduction and transfer areas, FIG. 4 a section through a rocker arm used as a control element in an arrangement between two cam shafts, FIG. 5 a section through a adjusting tappet used as a control element in an arrangement between a cam shaft and a valve, not shown, in a first control position, FIG. 6 the adjusting tappet in the view according to FIG. 5 in a second control position of the force introduction and transfer areas.

EMBODIMENT ACCORDING TO FIGS. 1 to 3

A cam shaft 1 used as a control element acts on a drag lever 2 serving as an adjustment element, said drag lever in turn controlling the motion of a valve, not shown, of an internal combustion engine. The engine valve, not shown, is spring loaded such that the valve stem end is pushed against the drag lever 2 by the force of the valve spring. In the following, the term force transfer area (KUB) is used for the area of the drag lever 2 with which the drag lever acts on the valve stem end, and it is referred to by reference number 3.

In axial direction, the cam shaft 1 has control contours 4, 5 adjacent to, but different from each other. These control contours 4, 5 correspond with contact areas on drag lever 2, which in the following are referred to as force introduction areas (KEB) and which are presented in the drawing as primary KEB area 6 and secondary KEB area 7. The primary KEB area 6 consists of rotatable primary roller 8 mounted in a fixed position within the drag lever 2.

The secondary KEB area 7 is formed by a rotatable secondary roller 11 mounted within a tappet 9 of a hydraulic unit 10. The KUB area 3 is integrated into a piston 12 of a further hydraulic unit 13. The hydraulic units 10 and 13 are hydraulically connected via a hydraulic control unit and via a connecting channel 14 (FIG. 2, 3). Along the connecting channel 14, there are hydraulic control valves (not shown in the drawing) for activating hydraulic units for which the connecting channel 14 is also connected with a hydraulic pressure source and a control line (not shown).

The drag lever 2 can pivot around a joint axis 15.

The control device described above operates as follows.

If the control curve 4 is required to be the controlling element for the valves, then tappet 9 with the secondary roller 11 are fully retracted into hydraulic unit 10 and the piston 12 of the hydraulic unit 13 is fully extended to a predetermined, set length and hydraulically locked. Due to the spring force acting on the valve stem of the engine valve, the drag lever 2 contacts the control contour 4 of the cam shaft 1 via the primary roller 8. Due to the piston 12 being hydraulically locked in the hydraulic unit 13, the engine valve is controlled via the drag lever 2, in a first control position, by the control contour 4 of the cam shaft 1.

If the engine valve is to be controlled by the control contour 5 of the cam shaft 1, then tappet 9 of the hydraulic unit 10 is moved to a fully extended setting with the aid of hydraulic control valves as a switching means (not shown) and the piston 12 of the hydraulic unit 13 is moved to a fully retracted setting. If tappet 9 and piston 12 are hydraulically locked in, these positions, the drag lever 2 controls the engine valve according to control contour 5 which is in contact with the secondary roller 11 of tappet 9. This control arrangement represents a second control position when compared to the first control position of the drag lever described above.

Adjustment elements of engine valves driven by a cam shaft normally have a so-called hydraulic valve play compensation. Such a hydraulic valve play compensation arrangement can easily be adopted for the present version of adjustment elements, by being integrated into the hydraulic unit 10 and 13. This can be achieved by applying generally known technical knowledge so that it is not necessary here to provide further technical explanations. In principle, for the described hydraulic units 10 or 13, it is sufficient to remove the stroke limitation described.

Due to the variability of the position of the KUB area 3 within the drag lever 2, it is possible to adjust the KEB areas 6 and 7 relative to each other such that these areas can follow different control contours 4 and 5 on the cam shaft 1 whereby one contour need not be positioned within the other contour. This is an essential advantage of the device in terms of the invention. At any one time, only one control contour drives the motion of the valve.

EMBODIMENT ACCORDING TO FIG. 4

In this embodiment, when compared with the device in FIGS. 1 to 3, functionally equivalent parts are given the same reference number.

In contrast to the embodiment in FIGS. 1 to 3, the embodiment according to FIG. 4 has two separate cam shafts 1, 1' with two different control contours 4' and 5' respectively. Instead of the drag lever 2 in the device described previously, a rocker arm 2' is used here. All other parts are equivalent so that a renewed description is not necessary.

The operation of the device according to FIG. 4 is as follows.

In a first control position of rocker arm 2', equivalent to the previously described first embodiment, the engine valve control is driven by the control contour 4' of the cam shaft 1' as one of the total of two cam shafts. In this operating mode, the tappet 9—contrary to its representation in the drawing—is retracted in the hydraulic unit 10 so that no contact occurs between this tappet 9 and the other cam shaft 1, i.e. during all rotary positions of the cam shaft 1. In this first control position, the piston 12 is fully extended.

In a second control position, which again is equivalent to the device according to FIGS. 1 to 3 which is shown in FIG. 4, the tappet 9 of hydraulic unit 10 is fully extended and the piston 12 fo hydraulic unit 13 is fully retracted. In this control position, the control emanating from rocker arm 2' is based on the control contour 5' of cam shaft 1.

The hydraulic valve play compensation arrangements normally part of control devices for engine valves, and mentioned previously already, can also be integrated into the hydraulic units 10 and 13 of this embodiment by removing the stroke limitations for the hydraulic units.

The cam shafts 1 and 1' can operate at different rotary speeds.

EMBODIMENTS ACCORDING TO FIGS. 5 AND 6

In this embodiment, too, when compared with the device in FIGS. 1 to 4, functionally equivalent parts are given the same reference number.

In this embodiment, too, when compared with the device in FIGS. 1 to 4, functionally equivalent parts are given the same reference number.

Instead of a lever as in the versions described previously, an adjustment tappet 2" is used in this embodiment as a control element between cam shaft and valve.

The operation of this device is equivalent to that of the embodiment according to FIG. 2 with reference to FIG. 5 and that of FIG. 3 with reference to FIG. 6 so that a renewed description is not necessary.

What is claimed is:

1. A control device for at least one spring-loaded intake or exhaust valve of an internal combustion engine with one adjustment element and at least one control element (2, 2', 2 " and 1, 1' respectively) in which a) the adjustment element (2, 2', 2") has a base body capable of motion and is located between at least one control element (1, 1') and the valve, b) the at least one control element (1, 1') rotates during the operation of the control device, c) through the at least one rotating control element (1, 1'), at least two rotating control element circumferential areas are present as control contours (4, 5) with differing contours around the circumference, d) on the base body of the adjustment element (2, 2', 2") are provided at least two force introduction areas KEB (6, 7), capable of being, positioned differently relative to each other, and one force transfer area KUB (3), e) the force transfer area (3) acts on the at least one engine valve, f) switching means are provided within the base body for alternatively correlating the KEB areas (6, 7) to the differing control curve areas (4, 5 ) of the control element (1, 1') for the purpose of force transmission, g) the control element (1, 1') exclusively has control curve areas which can be correlated, for the purpose of force transmission, to the KEB areas (6, 7) located within the base body of the adjustment element (2, 2', 2"), h) for alternatively correlating the KEB areas (6, 7) to the differing control curve areas of the control element (1, 1"), different positions relative to each other of all KEB and KUB areas (6, 7) and (3) respectively can be set with the switching means (10, 13) in relation to the distance between the control element (1, 1') and the valve whereby this is limited only by the control curves of the control element (1, 1'), wherein;

i) one of the two KEB areas (6, 7) as well as the KUB area (3) are adjustably mounted in the base body of the adjustment element (2, 2', 2"), j) by a change in the correlation to each other between the one KUB area (3) and the at least two KEB areas (6, 7), the switching means (10, 13) cause an exclusively hydraulic adjustment and locking of the adjustable KEB and KUB areas (6, 7) and (3) respectively within the base body of the adjustment element (2, 2', 2"), k) the KEB area (6 or 7) not required to transmit force at the time, can be switched into a position by the switching means (10, 13) where it is not in contact with the correlated control curve of control element (1, 1').

2. The control device according to claim 1, wherein the hydraulic valve play compensation measures, basically known in engine valve control technology, are integrated in the switching means (10, 13).

3. The control device according to claim 1, wherein at least two control elements in the form of cam shafts (1, 1') are provided.

4. The control device according to claim 3, wherein the at least two cam shafts (1, 1') rotate at different speeds during the operation of the control device.

* * * * *